US007350254B2

(12) United States Patent
Boulton

(10) Patent No.: US 7,350,254 B2
(45) Date of Patent: Apr. 1, 2008

(54) BRIDGING APPARATUS

(75) Inventor: John Francis Boulton, Merimbula (AU)

(73) Assignee: 19 Dean Street Pty Ltd, Pambula (AU)

( * ) Notice: Subject to any disclaimer, the term of this patent is extended or adjusted under 35 U.S.C. 154(b) by 0 days.

(21) Appl. No.: 10/519,101

(22) PCT Filed: Jun. 25, 2003

(86) PCT No.: PCT/AU03/00795

§ 371 (c)(1),
(2), (4) Date: Aug. 18, 2005

(87) PCT Pub. No.: WO2004/003298

PCT Pub. Date: Jan. 8, 2004

(65) Prior Publication Data

US 2006/0005329 A1 Jan. 12, 2006

(30) Foreign Application Priority Data

Jun. 26, 2002 (AU) ..... PS3177
Oct. 9, 2002 (AU) ..... 2002951935

(51) Int. Cl.
*E01D 15/12* (2006.01)

(52) U.S. Cl. ..... 14/2.4; 14/69.5

(58) Field of Classification Search ..... 14/2.4, 14/69.5

See application file for complete search history.

(56) References Cited

U.S. PATENT DOCUMENTS

| | | | | |
|---|---|---|---|---|
| 1,593,999 | A * | 7/1926 | Bingham | 14/2.4 |
| 1,674,279 | A * | 6/1928 | Ebeling | 14/69.5 |
| 1,733,587 | A * | 10/1929 | Ebeling | 14/2.4 |
| 2,449,829 | A * | 9/1948 | Agren | 14/69.5 |
| 3,875,603 | A * | 4/1975 | Mampaey | 14/71.3 |
| 4,084,713 | A * | 4/1978 | Rohrs et al. | 414/537 |
| 4,118,816 | A * | 10/1978 | Mittag | 14/69.5 |
| 4,162,551 | A * | 7/1979 | Serrano | 14/69.5 |
| 4,779,298 | A * | 10/1988 | Nichols et al. | 14/69.5 |
| 5,870,788 | A * | 2/1999 | Witkin | 14/69.5 |

FOREIGN PATENT DOCUMENTS

| | | |
|---|---|---|
| DE | 38 42 373 | 6/1990 |
| FR | 2 608 532 | 6/1988 |
| GB | 2 088 447 | 6/1982 |

* cited by examiner

*Primary Examiner*—Raymond W Addie
(74) *Attorney, Agent, or Firm*—Steptoe & Johnson LLP

(57) ABSTRACT

A bridging unit for use in bridging apparatus for traversing a bridging zone, the bridging unit including a stowage housing which in use is disposed to one side of the zone, a spanning assembly operatively mounted to the stowage housing for movement between a stowed position and a deployed position in which it at least partially traverses the bridging zone in an elevated position, and deployment means operable to cause movement of the spanning assembly between the stowed and deployed positions.

18 Claims, 12 Drawing Sheets

BRIDGING APPARATUS

CLAIM OF PRIORITY

Figure 1:
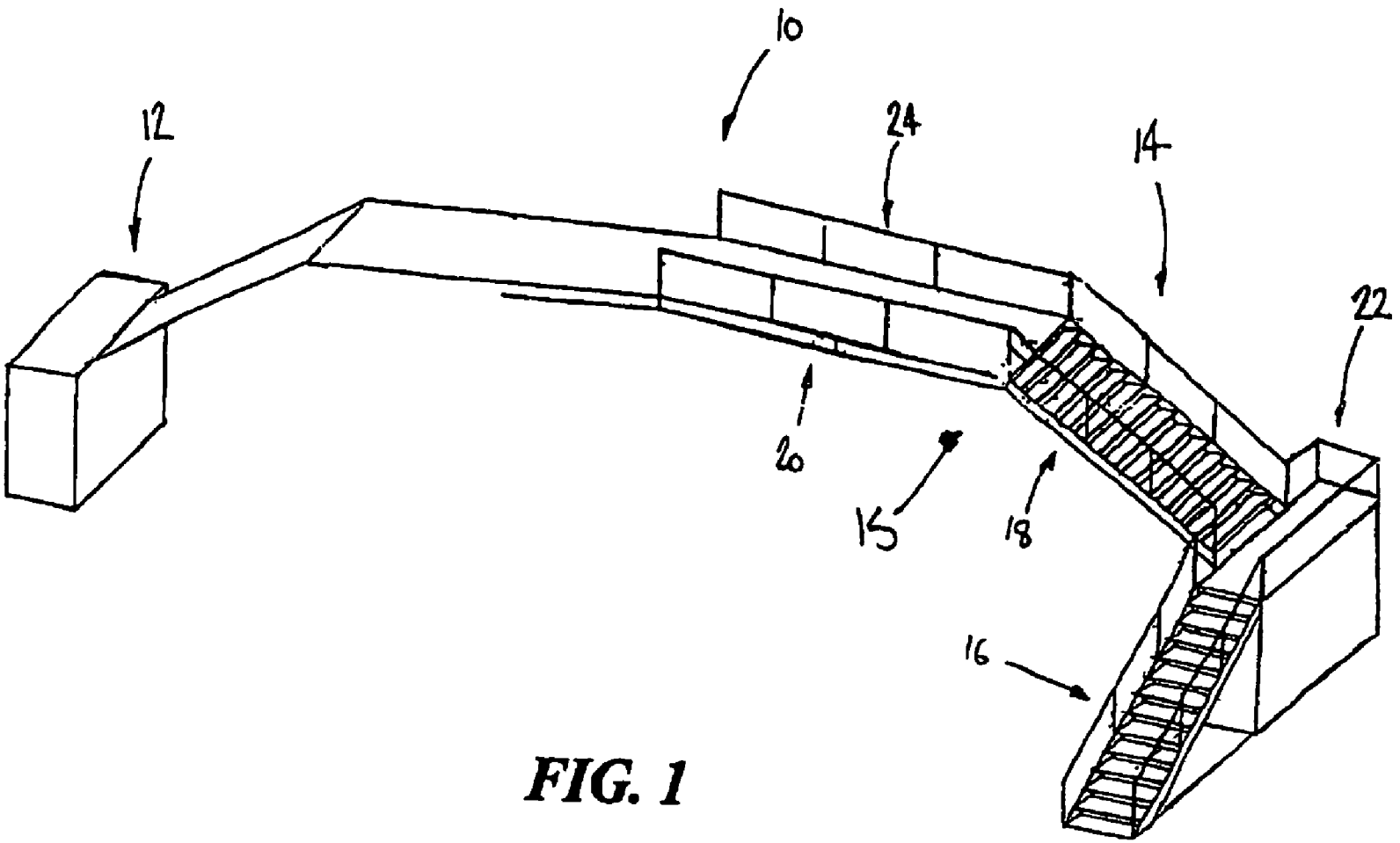

This application claims priority under 35 USC 371 to International Application No. PCT/AU2003/000795, filed on Jun. 25, 2003, which claims priority to Australian Provisional Patent Application No. PS3177, filed on Jun. 26, 2002, and to Australian Application No. 2002951935, filed on Oct. 9, 2002, the entire contents of which are hereby incorporated by reference.

Crossing roadways can subject pedestrians to serious risks of injury or death. Ground level pedestrian crossings reduce these risks but there is remains the possibility of pedestrians being injured by vehicles. Bridges and tunnels for traversing roadways have been proposed but these are often expensive and complicated structures. Additionally, such bridges and tunnels are fixed structures.

The present invention seeks to alleviate one or more of the aforementioned disadvantages.

According to one aspect of the present invention there is provided a bridging unit for use in bridging apparatus for use in traversing a bridging zone, the bridging unit including a stowage housing which in use is disposed to one side of the zone, a spanning assembly operatively mounted to the stowage housing for movement between a stowed position and a deployed position in which it at least partially traverses the bridging zone in an elevated position, and deployment means operable to cause movement of the spanning assembly between the stowed and deployed positions.

In one preferred form of the invention two bridging units are provided, each being of the type described above with the stowage housings of each unit being disposed on respective opposite sides of the bridging zone, the arrangement being such that when the spanning assembly of each unit are in the deployed position they operatively connect to one another.

The stowage housing of the unit may include a housing body having a compartment therein for at least partially receiving the spanning assembly therein when in the stowed position. The housing body may be generally a box-like structure which includes peripheral side walls and a top wall. The top wall may form a platform from which the spanning assembly is accessed when in the deployed position. Anchoring means may be provided for anchoring the stowage housing to the ground or other surface upon which it is supported. The stowage housing may be stored underground while in the stored position so as not to hinder regular pedestrian and other traffic, and may be raised to an aboveground position when ready for deployment.

The apparatus may further include access means for enabling access to the platform which forms part of the stowage housing. The access means may be operatively mounted to the stowage housing for movement between a stowed position and a deployed position. The access means may be in the form of a stairway, ladder, ramp assembly or like means.

Operative mounting for the access means may be in any suitable form, such as for example hooks or pivotable mechanisms. Deployment means for the access means may include extensible means such as hydraulic cylinders, screw jacks, cables and winch mechanisms, and the like. Deployment means may be powered by energy storage means such as batteries, or from mains power. Power supplies may drive deployment means through actuating means such as hydraulic or electric motors.

One preferred embodiment of access means may include a capsule suitable for use with, for example, wheelchairs or less mobile people. The capsule may itself be accessed by openable closure means in a peripheral wall of the storage means. Ramps to the capsule may be provided, as well as extra room for a carer who may assist with access by using a coded card. The capsule may be transferred to the platform via elevating means such as rams or chain and sprocket mechanisms, or the like.

The spanning assembly may include a path section and a passage section which in the deployed position are disposed in end to end relation and in the stowed position are disposed side by side, the two sections being movable relative to one another between the stowed and deployed positions. Preferably, when in the deployed position the passage section extends from the stowage housing with one end adjacent the upper wall thereof, the path section having one end located adjacent the other end of the passage section. The passage section may be in the form of an inclined stairway and the path section a generally horizontal support when in the deployed position. The spanning assembly may be constructed from any suitable material, such as for example high tensile aluminium.

In order to promote wheelchair access to the path section, the passage may include additional traversing means for the capsule. The capsule may be drawn across the platform and operatively connect to the passage section traversing means. This means may take the form of a motorised chain and winch system to draw the capsule up to the path, where access to the path may be effected through an openable closure in one wall of the capsule.

In one preferred form, when the passage and path sections of the spanning assembly are in the stored position they are disposed generally side by side in a generally upright configuration within the compartment or stowage housing. Preferably, one end of the two sections in their side by side configuration is disposed adjacent a lower part of the compartment. Movement of both sections may occur simultaneously, and include an initial linear movement so as to extend above the stowage housing. A further pivotal movement of the two sections may cause them to adopt a position in which they are both inclined with respect to the stowage housing. A final combination of pivotal and linear movement between the two sections can cause them to adopt the fully deployed position.

The deployment means for causing the aforementioned movement of the two sections may include a series of winches and cables, and gearing mechanisms. For example, a winch and cable assembly may be arranged to cause the first mentioned movement described above. The two sections may be adopted for pivotal movement about a pivot mounting in order to adopt the inclined positioned referred to above and a rack and pinion assembly may be provided to cause movement of the sections into the final deployed position. The pivotal movement may be initiated and controlled by an extensible means such as a hydraulic cylinder or viscous damper. Where viscous dampers are used in this application, a retracting mechanism may be required to take the path and passage sections from the deployed to the stowage position.

Traffic-control means may be provided, in order to ensure the maximum load is not exceeded on the spanning assembly. This may take the form of safety lights and/or boom gates which may be actuated by load cells on the spanning assembly. For example, load cells may determine the load on the spanning apparatus, and the safety lights glow red when the load cells detect a certain load quantity.

A cover means may be provided, in order to improve safety of bridging unit users and those below the spanning assembly, such as passing cars. This may take the form of a collapsible screen, which may form walls and/or roof of the spanning assembly. The cover means may be perforated in order to reduce wind loading.

Figure 2B:
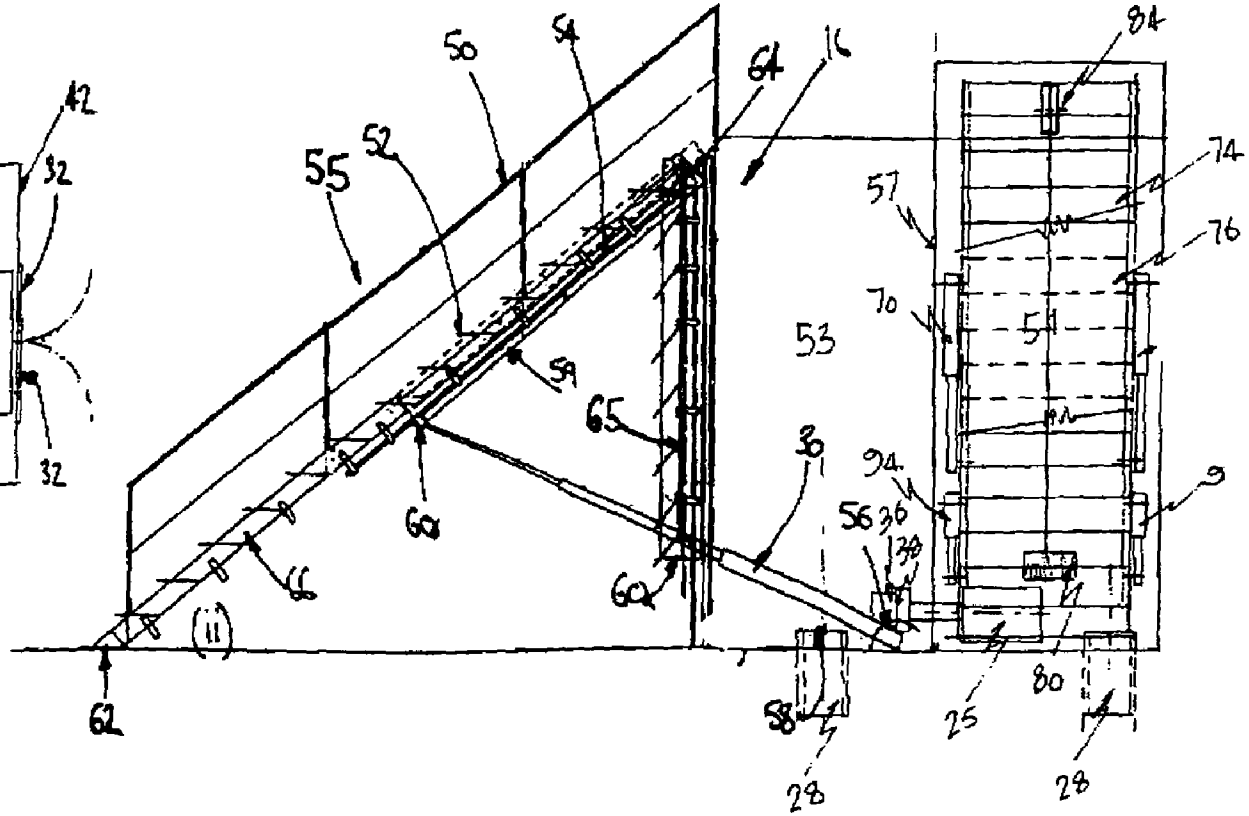
Figure 2A:
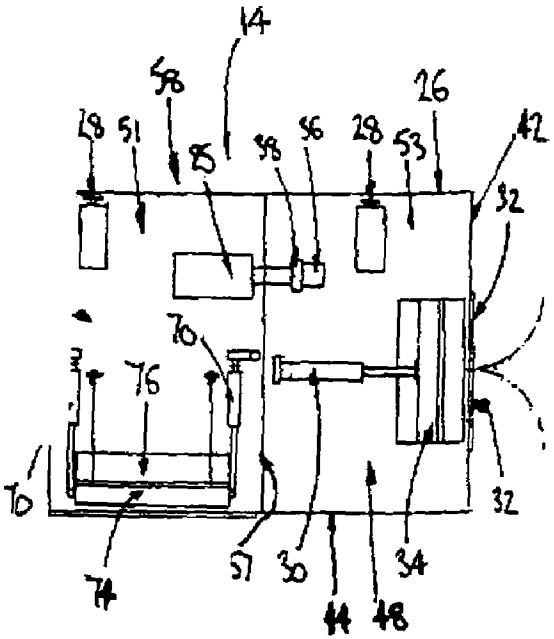
Figure 3A:
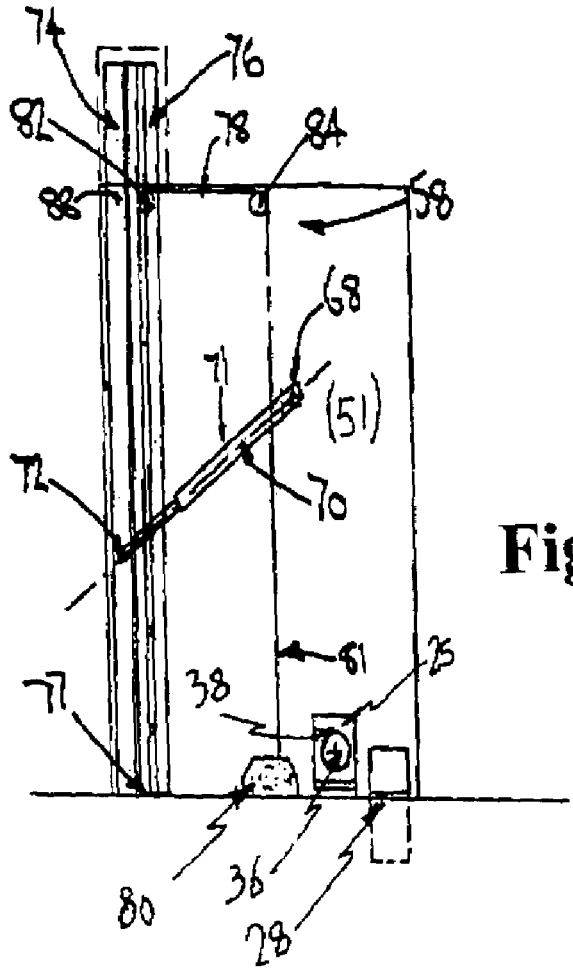
Figure 3B:
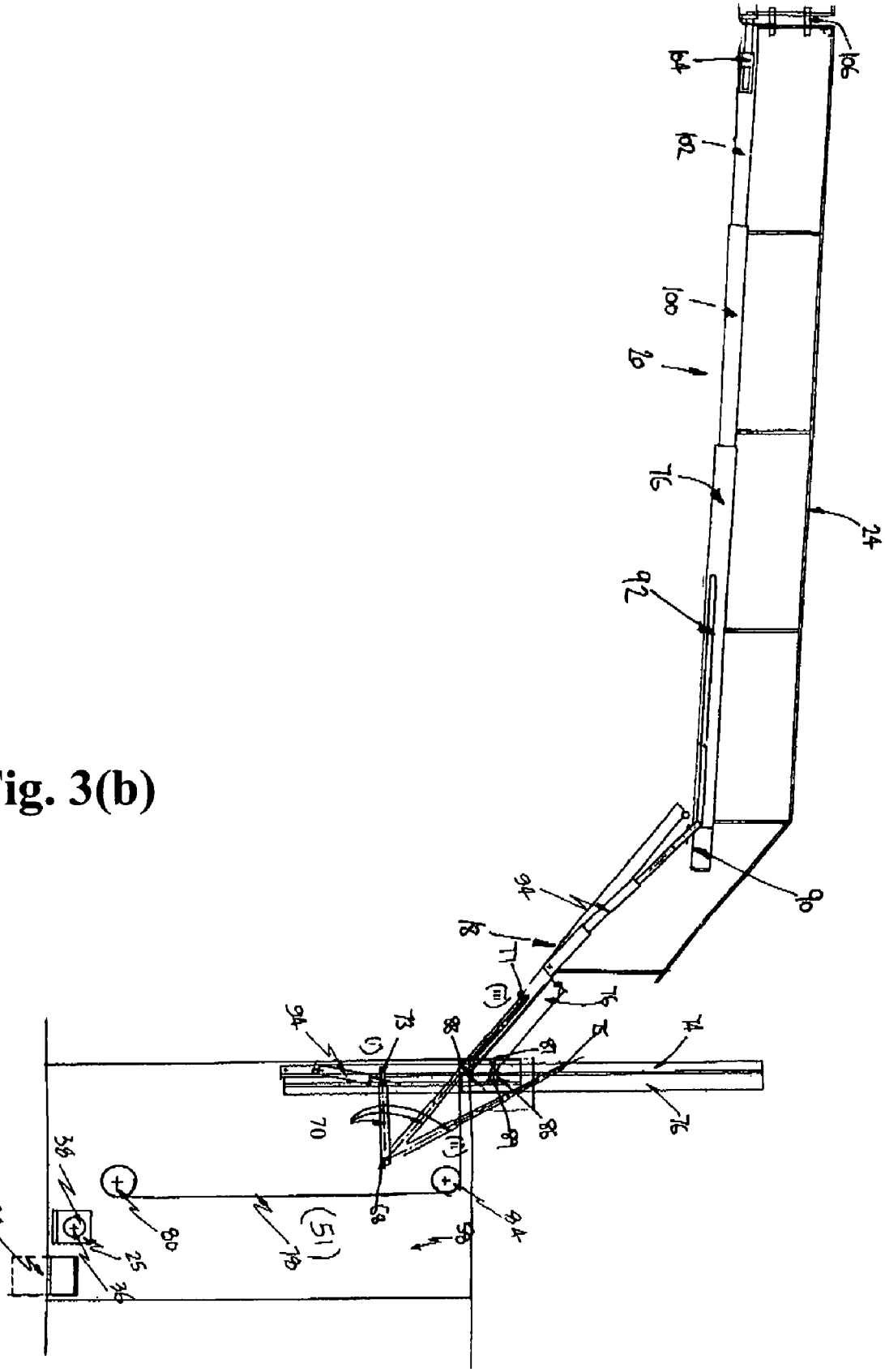
Figure 4A:
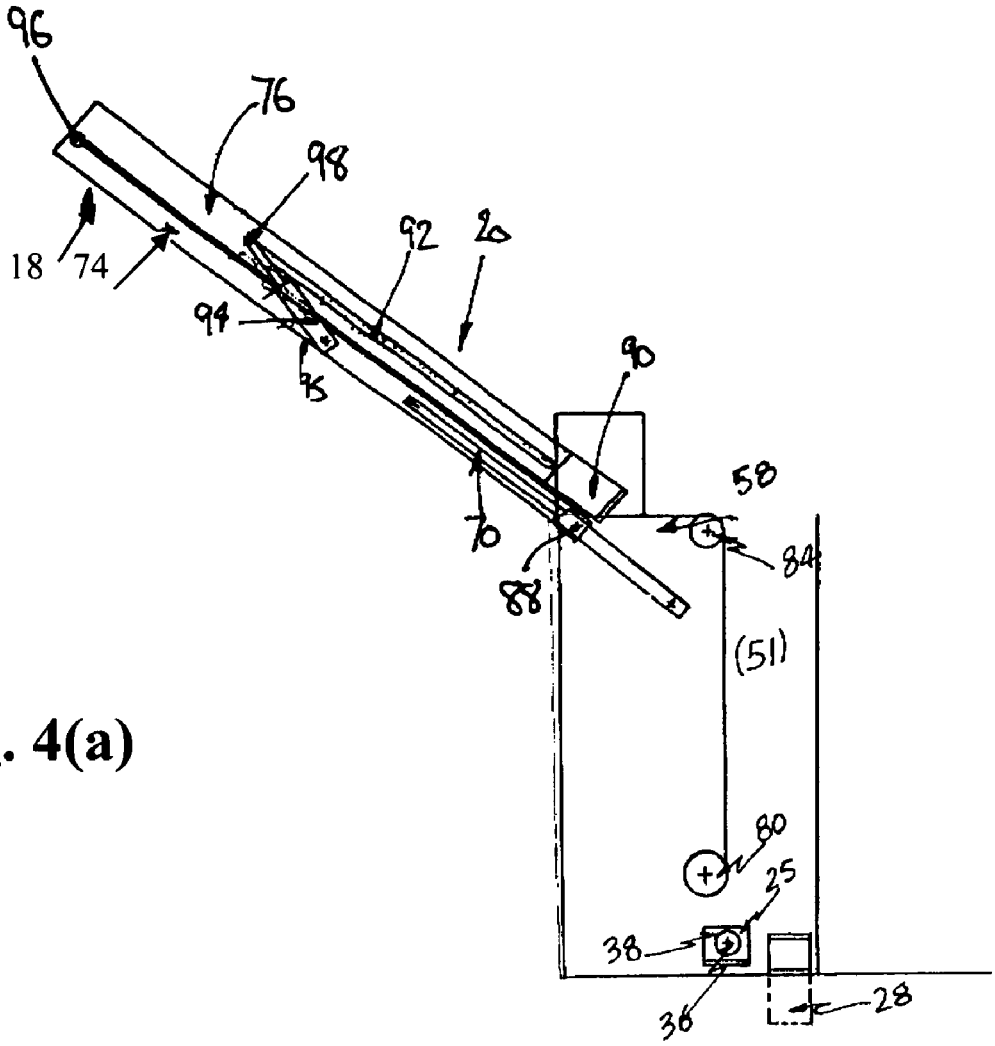
Figure 4B:
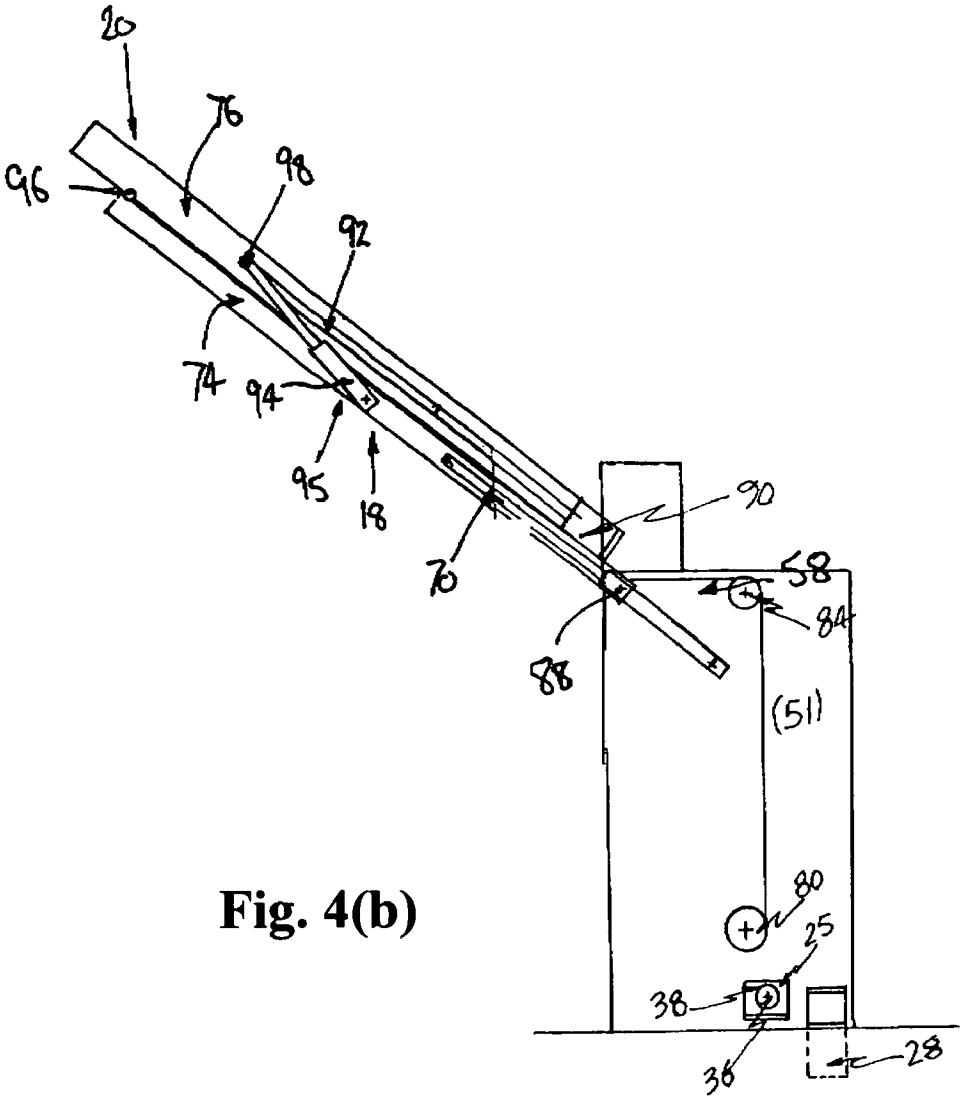
Figure 4C:
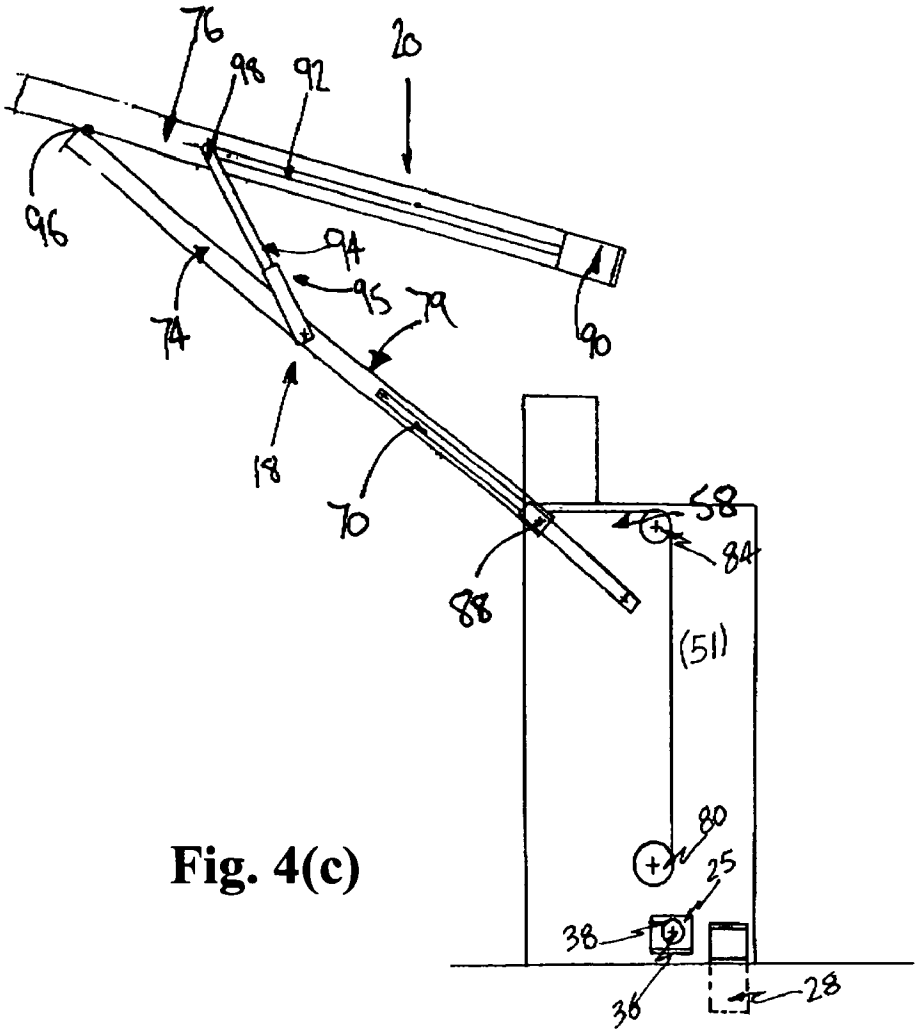
Figure 5A:
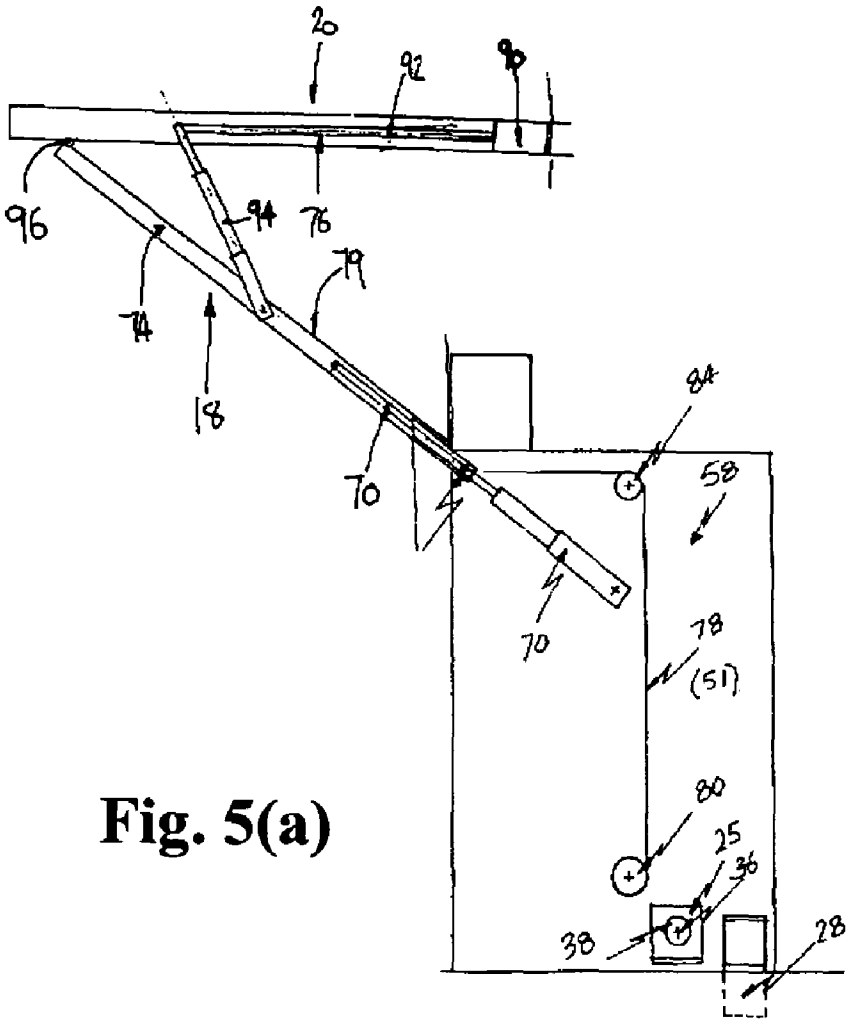
Figure 5C:
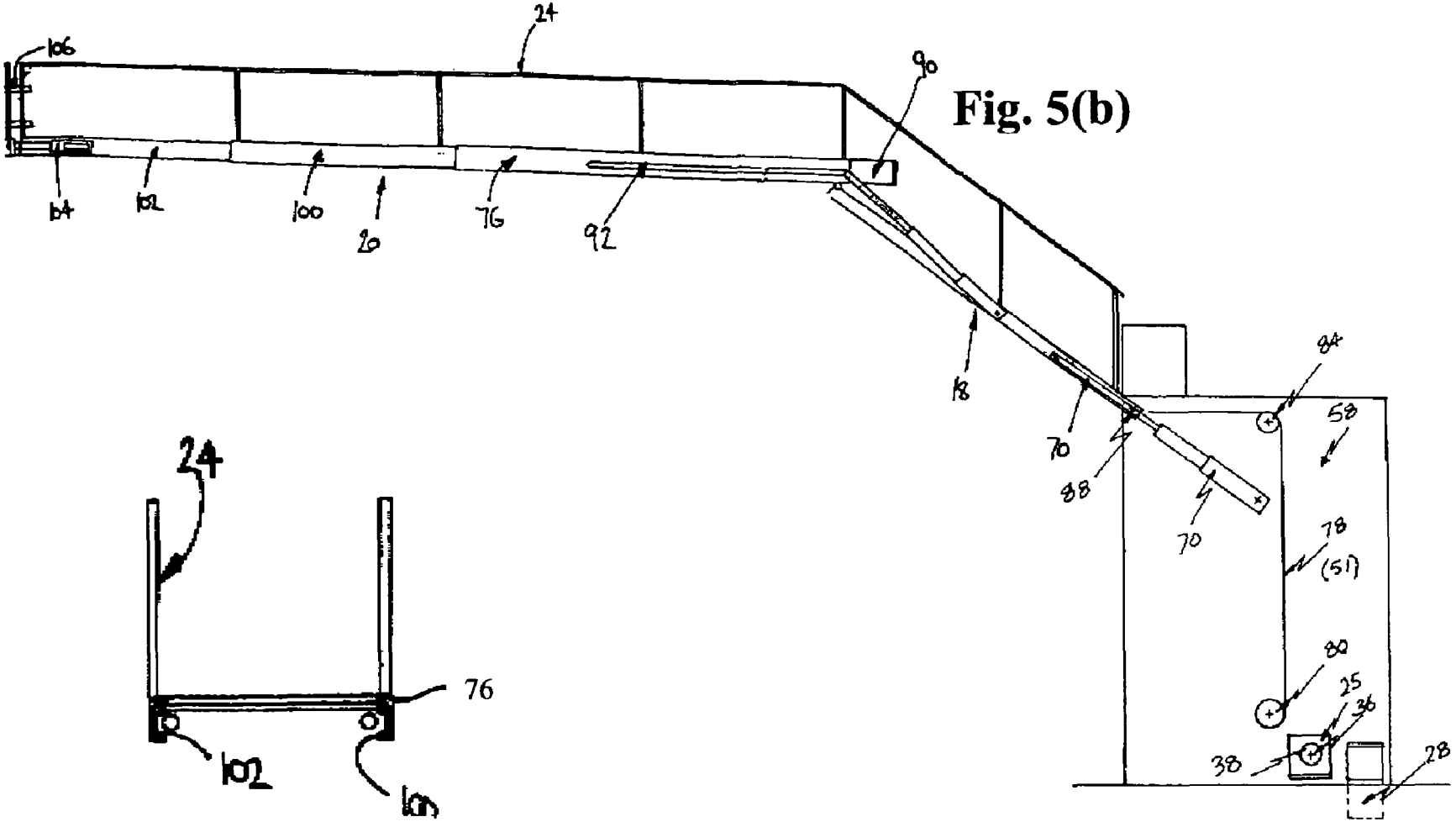
Figure 6:
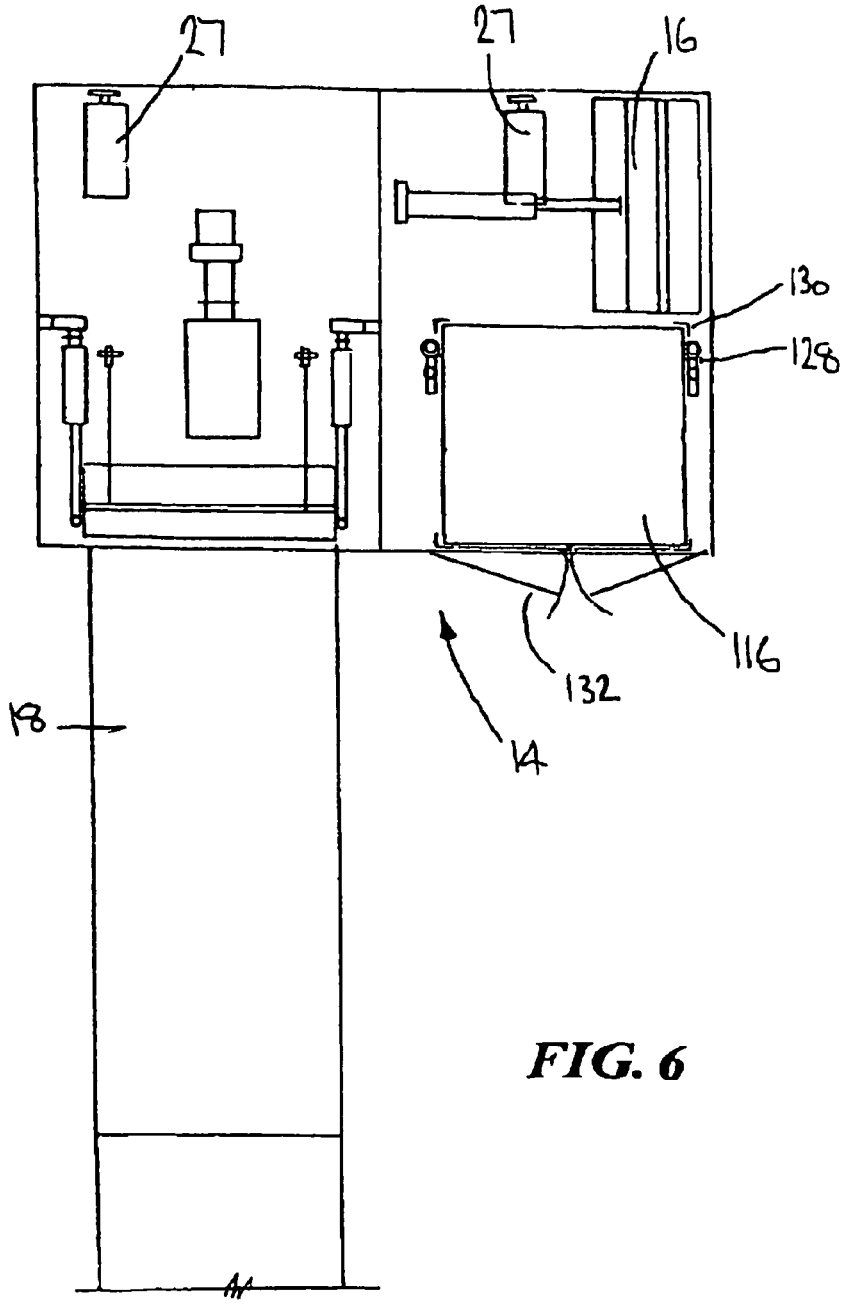
Figures 7A, 7B:
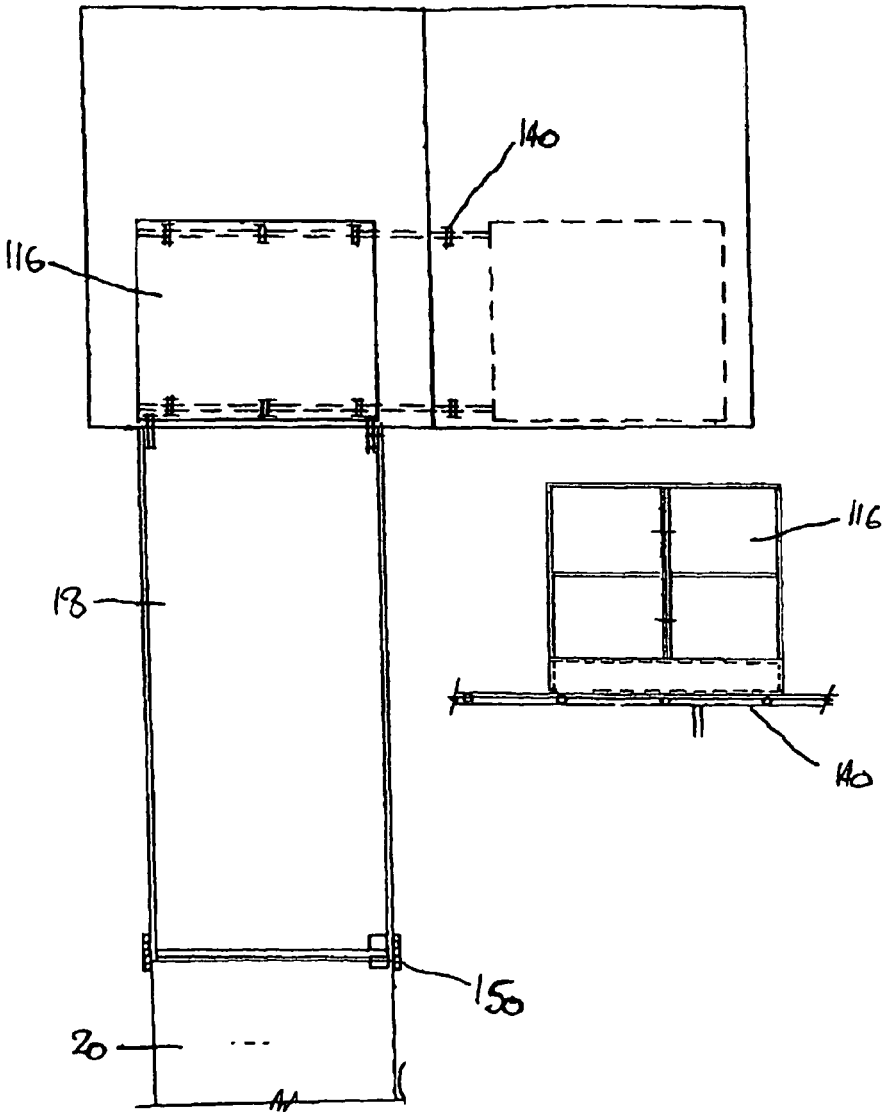

Preferred embodiments of the invention will hereinafter be described with reference to the accompanying drawings, and in those drawings:

FIG. 1 is a perspective view of an embodiment of the apparatus of the present invention, FIG. 2(*a*) is a plan view of a bridging unit of the apparatus in the stowed position, while FIG. 2(*b*) shows a side elevation view of the access means of the unit in both storage (i) and deployed (ii) positions, FIG. 3(*a*) shows an elevation view of the spanning assembly of the unit in a stowed position, FIG. 3(*b*) parts (i), (ii) and (iii) shows similar views of the spanning assembly in various intermediate positions between stowed and deployed positions, FIGS. 4(*a*), (*b*) and (*c*) show an elevation view of the spanning assembly shown in FIG. 3 in intermediate positions during deployment, FIG. 5(*a*) shows a penultimate stage of the spanning assembly before final deployment, FIG. 5(*b*) shows the spanning assembly in its final deployed position also operatively connected to a corresponding assembly of another apparatus, FIG. 5(*c*) is an end view of the path section, showing the location of telescoping strengthening sections, FIG. 6 is a plan view of the apparatus with the passage and path sections deployed, showing a second access means, being a capsule for wheelchair access in the ground-access position, FIG. 7(*a*) is a similar view, showing the capsule, having been elevated to the platform, and traversing over to the base of the passage. FIG. 7(*b*) shows a front elevation view of the apparatus which allows traversing across the platform, and FIG. 8(*a*) is a side elevation view of FIGS. 6 and 7, showing the capsule in ground-access position, and, in FIG. 8(*b*), at the top of the passage, ready to egress to the path section.

Referring to the drawings there is shown a bridging apparatus according to the present invention generally indicated at 10. The apparatus includes two substantially identical bridging units 12 and 14, each including a spanning assembly 15 movable between a first stowage position (FIG. 2(*a*)) and a second deployed position (FIG. 5(*b*)). The apparatus will hereinafter be described with reference to bridging unit 14, which includes a stowage housing which includes a main body 58 having a base wall 48 and top wall 46, opposed end walls 40 and 42 and opposed side walls 26 and 44. As best seen in FIG. 2(*a*) the main body is separated into two compartments 51 and 53 by dividing means 57. Openable closure means in the form of doors 32 are provided in wall 42.

In the stowage position shown in FIG. 2(*a*), the spanning assembly 16 is disposed within compartment 53. The unit further includes a first access means 16 which in the form shown is a flight of stairs 55 movable from the stowage position to the deployed position shown in FIG. 2(*b*). The flight of stairs 55 includes pivot 64 which allows the rotation of the stairs 55 into deployed position. The flight of stairs 55 includes a frame 59, operatively connected to a plurality of stairs 52, additional support means in the form of a collapsible handrail 50, and an extensible frame section 66 to which stairs 52 are also operatively connected. The control of extensible frame section 66 is achieved by screw jack 54. An extensible control means in the form of a hydraulic cylinder 30 also forms part of the elevating means 34, for the purpose of assisting in the deployment of the access means 34. The hydraulic cylinder is pivotally connected to the elevating means at 60 and to the main body 58 at 56.

Anchoring means 27 are provided in the form of extensible beams 28 for the purpose of securing the main body 58 to the ground. Anchoring means 27 may be caused to be positioned in a stowage position or a deployed position, or therebetween. While in the first stowage position, anchoring means 27 are disposed within the main body 58, and extend from the main body upon deployment.

The spanning means 15, includes a passage section 18 in the form of a flight of stairs 74 and a traversing path section 20 in the form of a support 76 both of which are disposed within compartment 51, when the device 14 is in the stowage position (shown in FIG. 3(*i*)). An elevating means 81 in the form of a winch 80 and cable 78 drawn around pulleys 82 and 84 is arranged so that the cable 78 is operatively connected to passage section 18 and forms part of the deployment apparatus of the passage section 18. The traversing path section 18 and passage section 20 are operatively connected, enabling both to be lifted simultaneously by elevating means 81. Further included in the deployment apparatus is extensible control means 71 in the form of hydraulic cylinders 70 and is pivotally mounted inside compartment 51 at 68 and 72.

Stop and pivot means are provided at 88, and pivot control means 86 are provided in the form shown as a pin 87 and arcuate slider 89, all for the purpose of allowing and controlling pivoting movement of passage section 18 and path section 20.

Further control means are provided for the deployment of path section 20. In the form shown, extensible control means 95 in the form of hydraulic cylinders 94 form one part of the control means. Other parts of the control means are in the form of roller device 96 and slider/pin device 92. Adjacent the roller device is a sprocket and drive shaft (not shown) to extend path means 20. To reduce load on drive shaft, sprocket and control means, a counterweight 90 is provided, operatively connected to path means 20.

Path section 20 also includes telescoping deck and support sections 76, 100 and 102, additional support means in the form of collapsible handrail 24, guidance means in the form of a laser device 104, and clamping means 106 for the purpose of connecting with corresponding support means deployed from the corresponding bridging unit 12.

Energy storage means are provided inside main body 58 and in the form shown are batteries 25. The batteries 25 power electric motors 38 which in turn drive and control hydraulic cylinders 30, 70 and 94.

To deploy the apparatus from the stowage position the openable closure means 32 in wall 42 are opened and motor 38 extends hydraulic cylinder 30, the outer pivotable end point of which extends from point 60*a* to 60*b*. This action pivots the access means 16 about pivot 64. The screw jack 54 then extends the frame section 66 until its outer point 62 reaches the ground. The stair treads 52 are then folded into a substantially horizontal position. The handrail 50 is then folded into position. Access is now available to the platform formed by the top wall 46 of the unit 14.

Anchor means 27 may be extended into cavities prepared in the ground, and the cavities may be filled with concrete or similar means (not shown) in order to secure the anchor means to the ground.

The passage section 18 and path section 20 are deployed through an openable closure (not shown) in the top wall 46. Motor 38 rotates winch 80 around which cable 78 is wound. Cable 78 is operatively connected to base 77, and the base 77 of passage section 18 and path section 20 is raised to pivot point 88. During this raising step, hydraulic cylinder 70 is allowed to extend and the ends thereof allowed to pivot about points 72 and 68.

When base 77 has reached pivot point 88, the outer end of the hydraulic cylinder 72 corresponds with point 75. At this point the passage section 18 and path section 20 are caused to pivot about point 88, and the rotation is controlled by the controlled extension of the hydraulic cylinder 70 in conjunction with motor 38, the passage of pin 87 through slider 89, and the pivoting of end points 75 and 68. The rotation stops when pin 87 has traversed the length of slider 89 and the hydraulic cylinder is substantially collinear with points 77, 88 and 68.

Deployment of the path section 20 then takes place, with the motor 38 extending hydraulic cylinder 94, rotating path means 20 about point 96 until it reaches a selected angle. Drive shaft and sprocket (not shown) then rotate to extend the path means 20. Endpoint 98 on hydraulic cylinder 94 slides along track 92 until it reaches the end of the track 92.

Telescopic path sections 100 and 102 then extend, and, using a guidance device 104 and clamps 106, section 102 is operatively connected with the corresponding telescoping section of bridging unit 12. The handrail 24 is folded into position.

Stairs 79 may be deployed at this stage, using a similar folding device as used in the access means 16.

The preceding steps have deployed an embodiment of the present invention which has provided an elevated pathway over a bridging zone, wherein people may walk up a flight of stairs 52, onto a platform 46, up a further flight of stairs 79, across a path support 20, and down the other side of a corresponding bridging device 12.

Each event in the deployment of the device may be completed by a switch thrown on a hand-held multiple switch device (not shown).

Figures 8A, 8B:
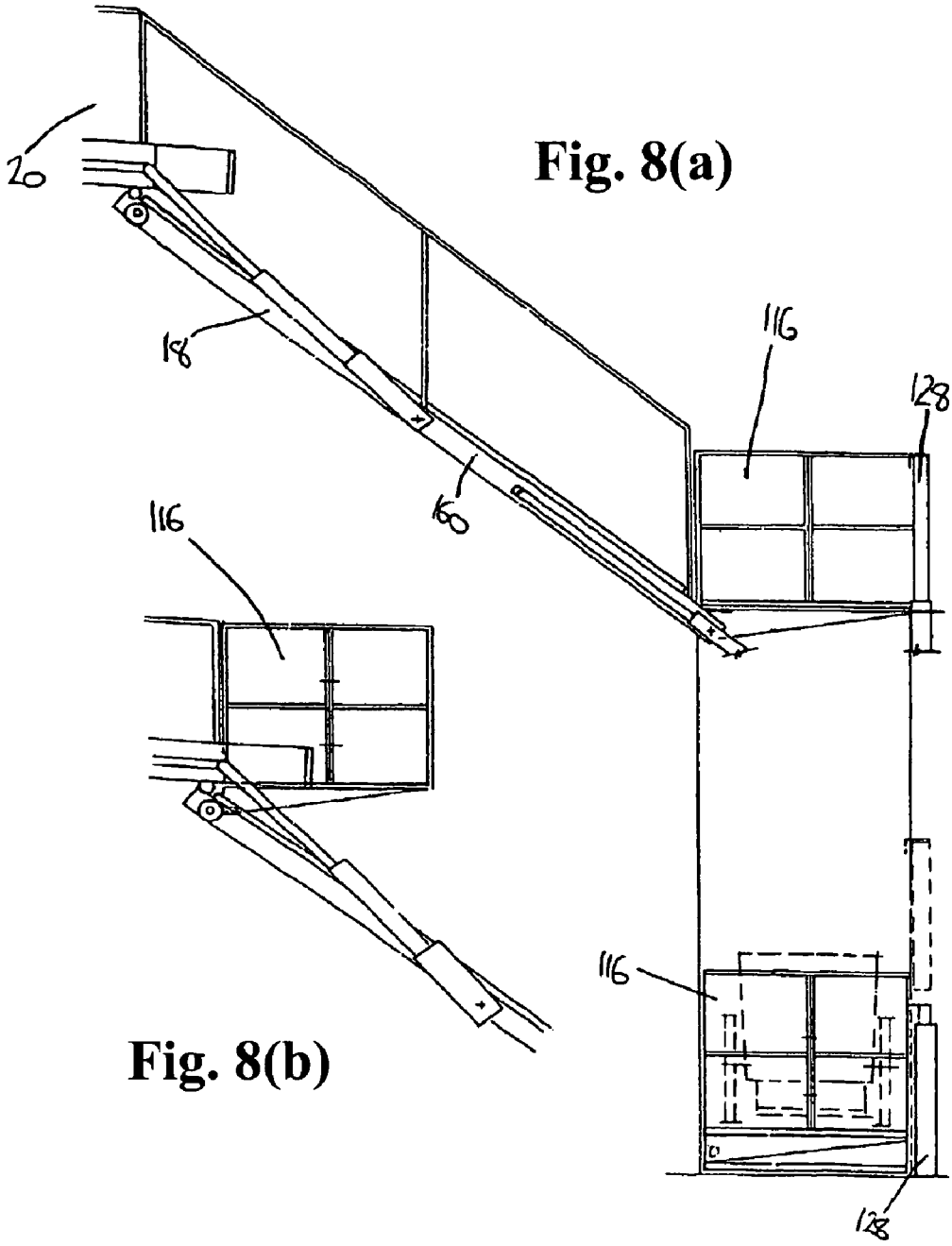

A second access means in the form of a capsule 116 is shown in FIGS. 6-8. In these figures, a person in a wheelchair or less mobile person accesses the capsule 116 via openable closure means in the form of doors 132 and ramps (not shown). Transfer means in the form of hydraulic rams 128 and guides 130 bring the capsule up to the height of the platform or top wall 46. The capsule 116 then traverses the platform 46 on slides and rollers 140 and is placed in position at the base of the passage 18. The capsule is then operatively connected to a further traversing means in the form of motorised chain and winch system 150, assisted by strengthened side beams 160. The capsule is delivered by the traversing means to the top of the passage and the person may exit the capsule and move across the path section 20. Access by less able persons may be assisted by a carer, who may ride in the capsule, using a coded access card for access to switches, buttons, etc.

The apparatus described above refers to the particular application of the invention as a pedestrian walkway. It will be readily apparent however that the apparatus could take various forms for different applications. For example, the bridging apparatus could be designed for use as a bridge for vehicles including heavy vehicles such as tanks and the like. In such applications stairways would be replaced with ramps and additional strengthening may be required for such heavy duty applications. For example, in the case of pedestrian crossings lightweight materials such as aluminium may be suitable for use whereas for more heavy duty applications steel may be required for use in the construction of the various parts.

Finally, it is to be understood that various alterations, modifications and/or additions may be incorporated into the various constructions and arrangements of parts without departing from the spirit or ambit of the invention.

I claim:

1. A bridging unit configured to engage with a like bridging unit for traversing a bridging zone, the bridging unit including a stowage housing in use being disposed to one side of the bridging zone, and including a housing body comprising a box-like structure having opposed peripheral walls, the box-like structure having a compartment therein for receiving a spanning assembly movable between a stowed position in which position the spanning assembly is disposed within the compartment and a deployed position in which position the spanning assembly is disposed outside the box-like structure so as to at least partially traverse the bridging zone in an elevated position, and deployment apparatus operable to cause movement of the spanning assembly between the stowed and deployed positions.

2. A bridging unit according to claim 1 wherein said housing body includes a top wall which forms a platform from which the spanning assembly is accessed when in the deployed position.

3. A bridging unit according to claim 1 including access apparatus for enabling access to the platform, the access apparatus being operatively mounted to the stowage housing for movement between a stowed position and a deployed position.

4. Bridging apparatus including two bridging units according to claim 1, the bridging units engaged to one another at outer ends of the spanning assembly.

5. A bridging unit in accordance with claim 1 wherein the spanning assembly includes a plurality of spanning members or beams configured to deploy telescopically or extensibly into the deployed position in an elevated position.

6. A bridging unit in accordance with claim 1 wherein a handrail is operatively connected to the spanning assembly, the handrail configured to move between a parked position adjacent the spinning assembly, and an erect position in which position the handrail is spaced from the spanning assembly for gripping by users of the bridging unit.

7. A bridging unit in accordance with claim 1 wherein the deployment apparatus includes an electric motor to deploy the spanning assembly.

8. A bridging unit in accordance with claim 1 wherein the deployment apparatus includes hydraulic arms to facilitate deployment of the spanning assembly.

9. A bridging unit in accordance with claim 1 wherein a power supply is provided to facilitate deployment of the spanning assembly.

10. A bridging unit in accordance with claim 1 wherein an anchor is provided to anchor the storage housing to the ground.

11. A bridging unit in accordance with claim 1 wherein the storage housing is configured to be buried in the ground.

12. A bridging unit according to claim 1 wherein the spanning assembly includes a path section and a passage section which in the deployed position are disposed in end to end relation and in the stowed position are disposed side by side, the two sections being movable relative to one another between the stowed and deployed positions.

13. A bridging unit according to claim 12 wherein when the passage and path sections of the spanning assembly are in the stowed position they are disposed side by side in a substantially upright configuration within the compartment or stowage housing.

14. A bridging unit according to claim 13 wherein said passage section and said path section are operatively connected together for relative pivotal and linear movement and said passage section is pivotally mounted to said housing the arrangement being such that said passage section is pivotally movable relative to the housing from the stowed to the deployed positions and thereafter said path section is both pivotally and linearly moved relative to the passage section so as to adopt its deployed position in which it is arranged generally end to end with respect to the passage section.

15. A bridging unit in accordance with claim 1 wherein a cover is provided to cover the spanning assembly when in the deployed position.

16. A bridging unit in accordance with claim 15 wherein the cover is a perforated screen to reduce wind loading.

17. A bridging unit in accordance with claim 1 wherein a transfer apparatus is provided to transfer a person along or adjacent the spanning assembly.

18. A bridging unit in accordance with claim 17 wherein the transfer apparatus includes a capsule driven by a hydraulic arm.

* * * * *